US008347566B2

(12) United States Patent
Knapp

(10) Patent No.: US 8,347,566 B2
(45) Date of Patent: Jan. 8, 2013

(54) DEVICE FOR CONNECTING MULLIONS TO TRANSOMS AND REINFORCING PLATE THEREFOR

(76) Inventor: Friedrich Knapp, Bad Kreuzen (AT)

( * ) Notice: Subject to any disclaimer, the term of this patent is extended or adjusted under 35 U.S.C. 154(b) by 0 days.

(21) Appl. No.: 12/811,298

(22) PCT Filed: Dec. 31, 2008

(86) PCT No.: PCT/IB2008/003831
§ 371 (c)(1),
(2), (4) Date: Feb. 4, 2011

(87) PCT Pub. No.: WO2009/087481
PCT Pub. Date: Jul. 16, 2009

(65) Prior Publication Data

US 2011/0192109 A1 Aug. 11, 2011

(30) Foreign Application Priority Data

Dec. 31, 2007 (DE) ..... 10 2007 063 389

(51) Int. Cl.
*E06B 3/00* (2006.01)
*E06B 3/988* (2006.01)
*E06B 3/68* (2006.01)

(52) U.S. Cl. ..... 52/204.6; 52/204.72; 52/204.71; 52/204.5

(58) Field of Classification Search ..... 52/204.6, 52/204.5, 208, 204.54, 204.55, 204.62, 204.63, 52/204.7, 204.71, 204.72
See application file for complete search history.

(56) References Cited

U.S. PATENT DOCUMENTS

| | | | | |
|---|---|---|---|---|
| 3,798,862 | A * | 3/1974 | Stoakes | 52/204.591 |
| 3,844,084 | A * | 10/1974 | Hubbard et al. | 52/843 |
| 3,940,897 | A * | 3/1976 | Stoakes | 52/395 |
| 4,707,959 | A * | 11/1987 | Stoakes | 52/235 |
| 5,632,125 | A * | 5/1997 | Osanai | 52/235 |
| 7,877,939 | B2 | 2/2011 | Knapp | |
| 2005/0284053 | A1 * | 12/2005 | Grunewald et al. | 52/235 |
| 2006/0201084 | A1 * | 9/2006 | Arias | 52/235 |
| 2007/0154258 | A1 | 7/2007 | Knapp | |
| 2010/0115863 | A1 * | 5/2010 | Braybrook | 52/204.62 |

FOREIGN PATENT DOCUMENTS

| | | | |
|---|---|---|---|
| DE | 198 39 980 | C1 | 3/2000 |
| EP | 0 496 187 | A1 | 7/1992 |
| EP | 1 020 579 | A2 | 7/2000 |
| WO | WO 02/101166 | A1 | 12/2002 |

* cited by examiner

*Primary Examiner* — Mark Wendell
(74) *Attorney, Agent, or Firm* — Henry M. Feiereisen, LLC

(57) ABSTRACT

A connecting device for connecting a mullion to a transom, each having a T-shaped metal profile fastened to the end face thereof in order to accommodate panes of glass, wherein the mullion is connected to the transom by means of a main connecting device and reinforcing means are provided to increase the stability of the mullion/transom connection, is characterized in that the reinforcing means is a reinforcing plate having the following features: a base-plate portion with fastening holes for fastening to the end face of the mullion, said mullion having a recess corresponding to the size and thickness of the base-plate portion, wherein the recess is open laterally, and two tongues bent in parallel to the plane of the base-plate portion, extending at a distance to one another and provided with fastening holes, said tongues engaging over the projecting T-shaped metal profile of the transom.

2 Claims, 4 Drawing Sheets

DEVICE FOR CONNECTING MULLIONS TO TRANSOMS AND REINFORCING PLATE THEREFOR

CROSS-REFERENCES TO RELATED APPLICATIONS

This application is the U.S. National Stage of International Application No. PCT/IB2008/003831, filed Dec. 31, 2008, which designated the United States and has been published as International Publication No. WO 2009/087481A2 and which claims the priority of German Patent Application, Serial No. 10 2007 063 389.2, filed Dec. 31, 2007 pursuant to 35 U.S.C. 119(a)-(d).

BACKGROUND OF THE INVENTION

The invention relates to a connecting device for producing a mullion/transom connection with attached aluminum profiles for panes of glass. This connecting technique is used, for example, in a façade construction. Furthermore, the invention relates to a reinforcing plate for increasing the stability of the mullion/transom connection.

Mullion/transom connections are sufficiently known from prior art so that principal explanations can be dispensed with. Mullion/transom connections for producing façades of glass have to withstand high loads as the weighty panes of glass generate strong bending moments.

Therefore, as known from prior art, T-shaped reinforcing elements 6 are bolted to the end face of the connection. However, as aluminum profiles for the panes of glass are also bolted to this end face, the T-shaped reinforcing elements have to be countersunk. This requires costly milling work to be performed, which, in most cases, has to be done on the spot, see FIGS. 5 and 6.

In order to avoid this disadvantage, according to prior art, the aluminum profile is used to absorb bending moments. In order to gain this effect, part of the aluminum profile of the mullion must be cut out at the joint. A tongue 8 protruding from the aluminum profile is inserted into this recess. The area around the joint is bolted by using long wood screws, as shown in FIGS. 7 and 8. However, this solution comprises the following disadvantages:

The protruding tongue 8 of the aluminum profile can easily be bent during transport. For this reason, the aluminum profiles are only bolted to the transoms at the construction site. However, this is a complicated procedure because a high-effective bolting technique is not available at the construction site. Using protection caps to prevent the tongues 8 from being damaged is also complicated.

SUMMARY OF THE INVENTION

Therefore, object of the invention is to provide a connecting device with which the disadvantages mentioned above are provided. This connecting device shall be capable of absorbing reliably the bending moment applied by the weight of glass panes. Furthermore, this connecting device shall easily be mountable and sturdy.

This object is attained by a connecting device for connecting a mullion with a transom, to the front sides of which a T-shaped profile each for holding panes of glass is fixed, and which includes a main connecting device with which the mullion is connectable to the transom. To increase the stability of the mullion/transom connection, reinforcing means in the shape of a reinforcing plate are provided, the features thereof being: a base-plate portion with fastening with holes for fastening to the front side of the transom. The transom is provided with a recess corresponding to the size and thickness of the base-plate portion. The recess is open laterally and, together with the T-shaped metal profile attached onto it, forms a slot for inserting the base-plate portion. Fork-like tongues extend from the base-plate portion and are bent in parallel to the plane thereof. These tongues engage over the projecting T-shaped metal profile of the transom and are provided with fastening holes so that they can be bolted onto the T-shaped metal profile by using wood screws.

According to another feature of the present invention, the reinforcing plate is made of high-strength high-grade steel. Thus, the stability of the total connection can be improved remarkably.

According to another feature of the present invention, a special reinforcing plate for the connecting device, includes the following features: a base-plate portion with fastening holes for fastening to the front side of a transom having a recess corresponding to the size and the thickness of the base-plate portion, wherein the recess is open laterally. Two tongues, which are provided with fastening holes, extend from the base-plate portion and are bent in parallel to the plane thereof. These tongues extend with a distance to one another so that they can engage over the element projecting from the T-shaped metal profile of the transom.

BRIEF DESCRIPTION OF THE DRAWING

Below, the invention will be explained in detail by means of a practical example and schematic drawings.

DETAILED DESCRIPTION OF PREFERRED EMBODIMENTS

Figure 1:
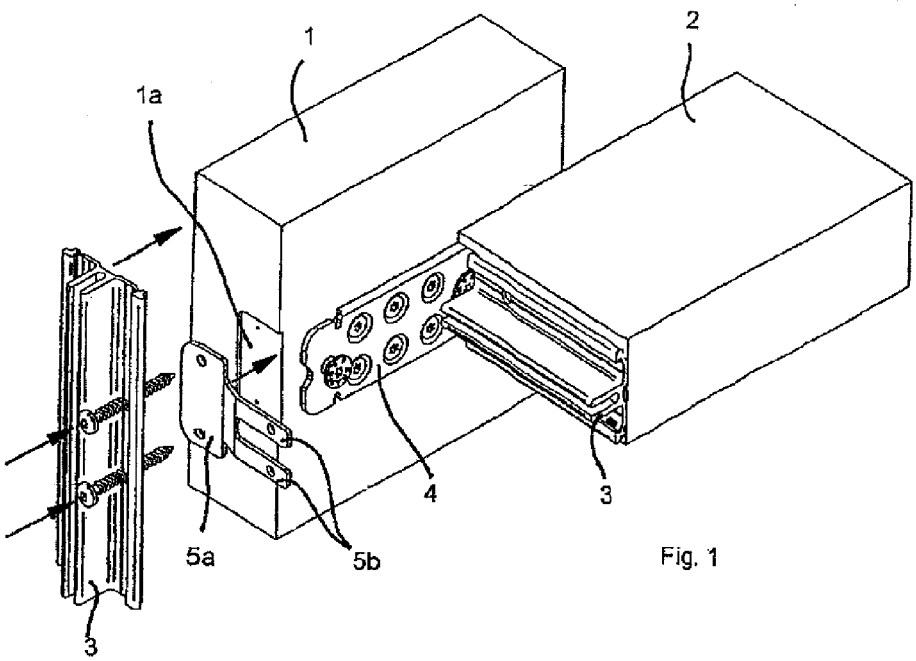
FIG. 1 is a perspective view of a first mounting state of the invention.
Figure 2:
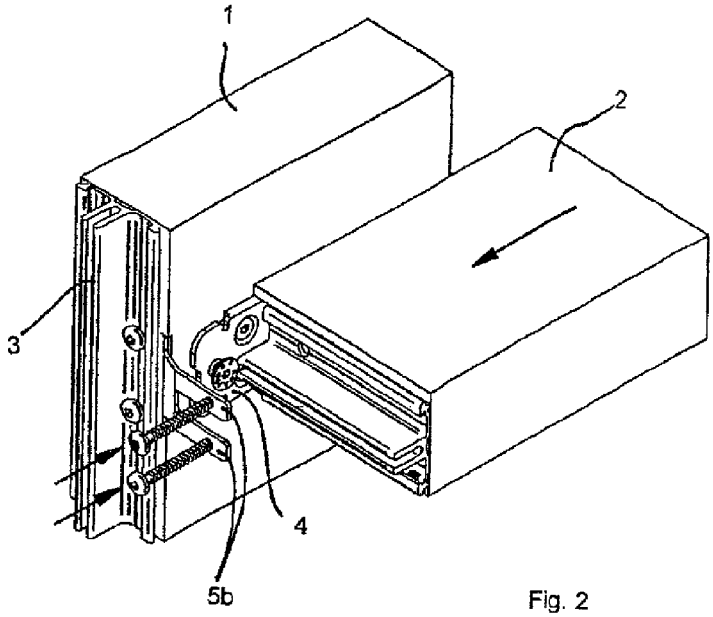
FIG. 2 is a perspective view of a second mounting state of the invention.
Figure 3:
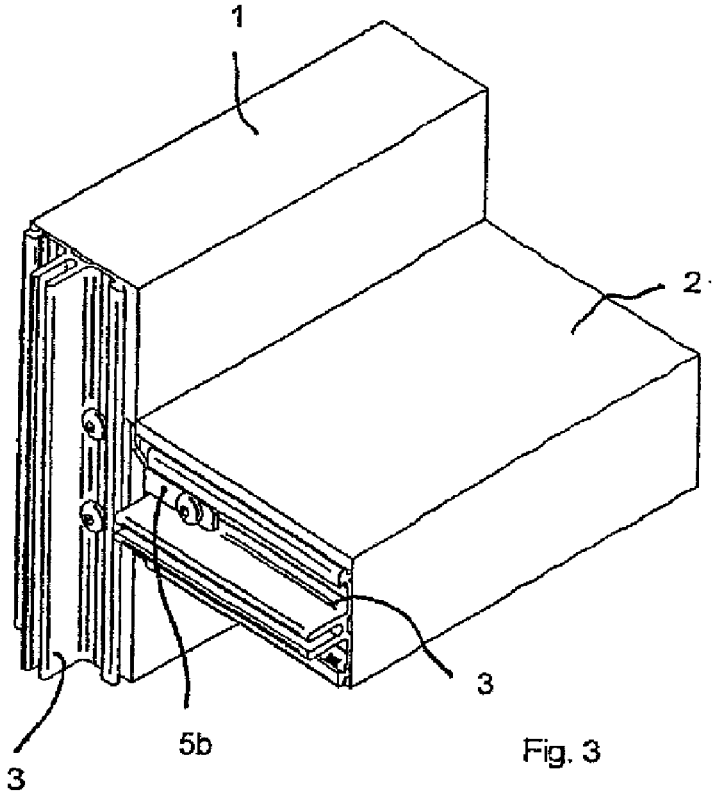
FIG. 3 is a perspective view of a third mounting state of the invention.
Figure 4:
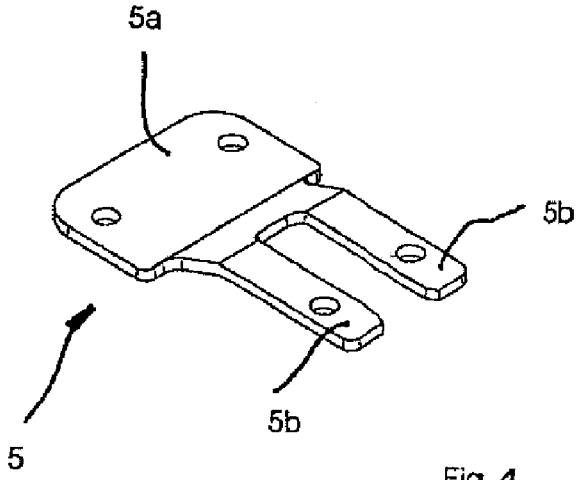
FIG. 4 is a perspective view of a reinforcing plate.

FIG. 1 shows a perspective view of a first mounting state of the invention. A mullion 1 is to be connected to a transom 2 by means of a main connecting device 4. A T-shaped metal profile 3 each for installing panes of glass is fastened to the front side of the mullion 1 and to that of the transom 2. The mounting state at the mullion 1 is shown as an explosive view. The front side of the mullion 1 is provided with a flat recess 1*a* into which the reinforcing plate 5 is laterally inserted at a later point of time. At first, a T-shaped metal profile 3 is fastened to the front side of the mullion 1 and then, another T-shaped metal profile 3 is fastened to the front side of the transom 2. These procedures are carried out in a factory, i.e., not at the construction site. Therefore, the T-shaped metal profiles 3 can be fastened automatically and very precisely. At the construction site, the transom is put on and moved in the direction marked by an arrow so that the connecting portions of the main connecting device 4 are forced into engagement. Then, the base-plate portion 5*a* of a reinforcing plate 5 is laterally inserted into the recess 1*a* and screwed on by a mechanic, as shown in FIG. 2*a*. Afterwards, the screws marked by arrows are inserted into the fastening holes of the tongues 5*b* and screwed into the transom. FIG. 3 shows the mullion/transom connection in the final state of mounting and FIG. 4 a perspective view of the bent reinforcing plate which, with this practical example, is made of a corrosion-resistant high-grade steel.

Figure 5:
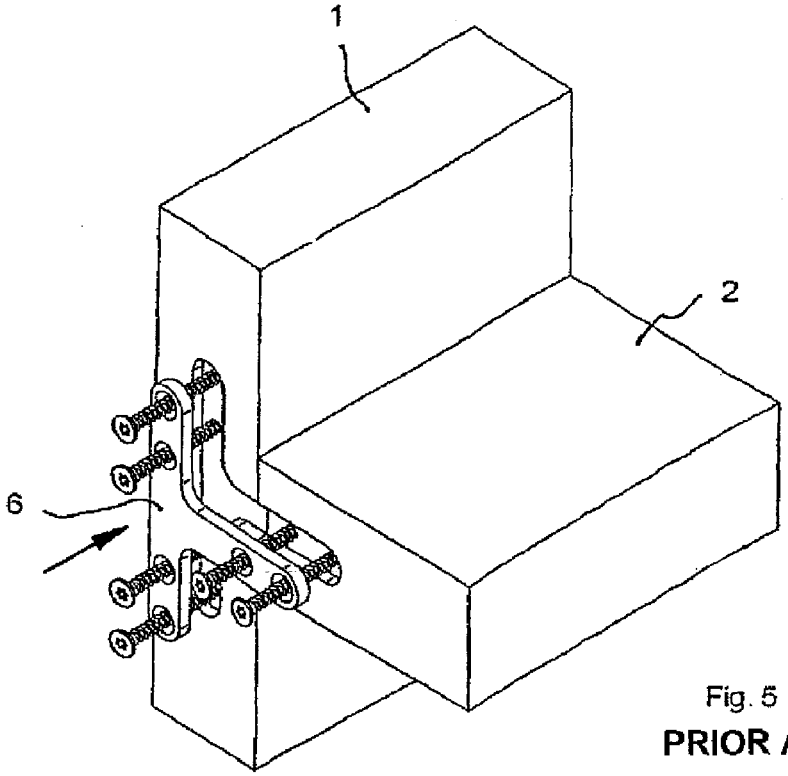
Fig. 5 PRIOR ART
FIG. 5 is a perspective view of a first mounting state of a first connection according to the prior art.
Figure 6:
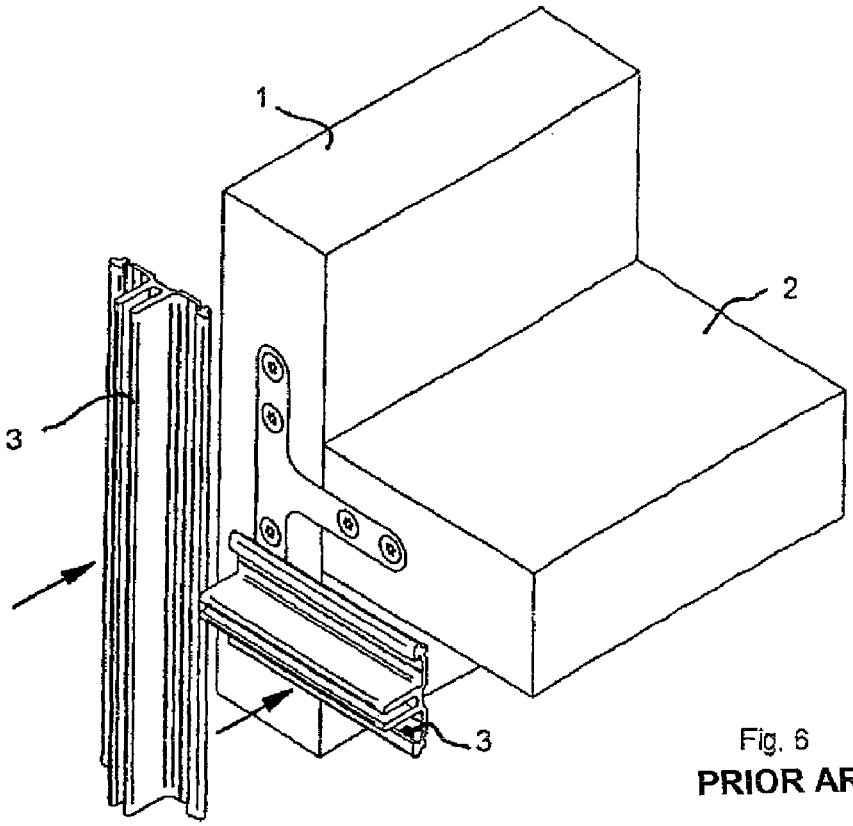
Fig. 6 PRIOR ART
FIG. 6 is a perspective view of a second mounting state of the first connection according to the prior art.
Figure 7:
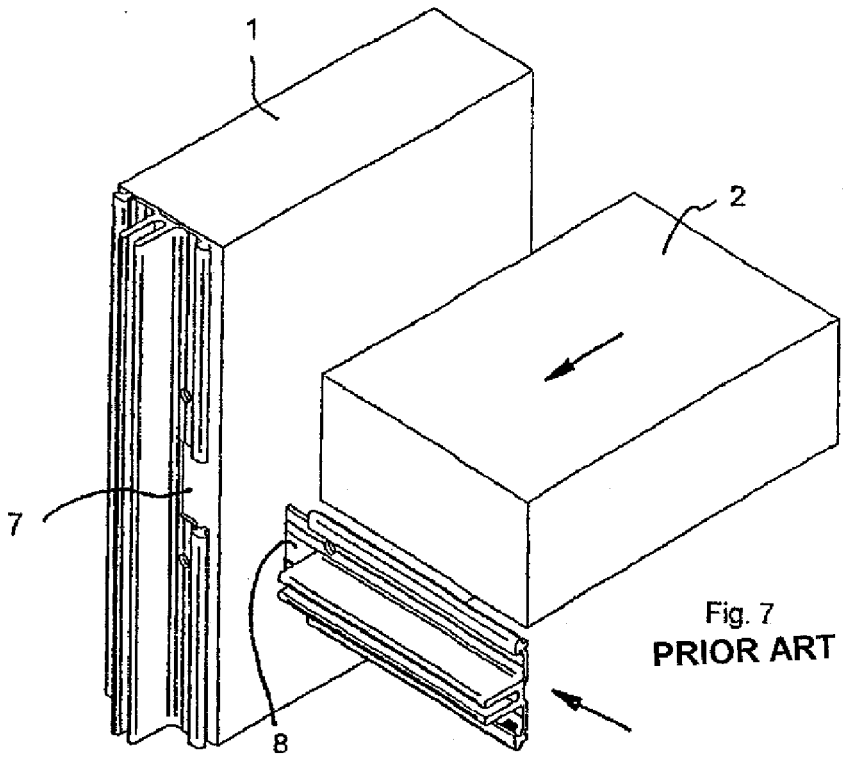
Fig. 7 PRIOR ART
FIG. 7 is a perspective view of a first mounting state of a second connection according to the prior art.
Figure 8:
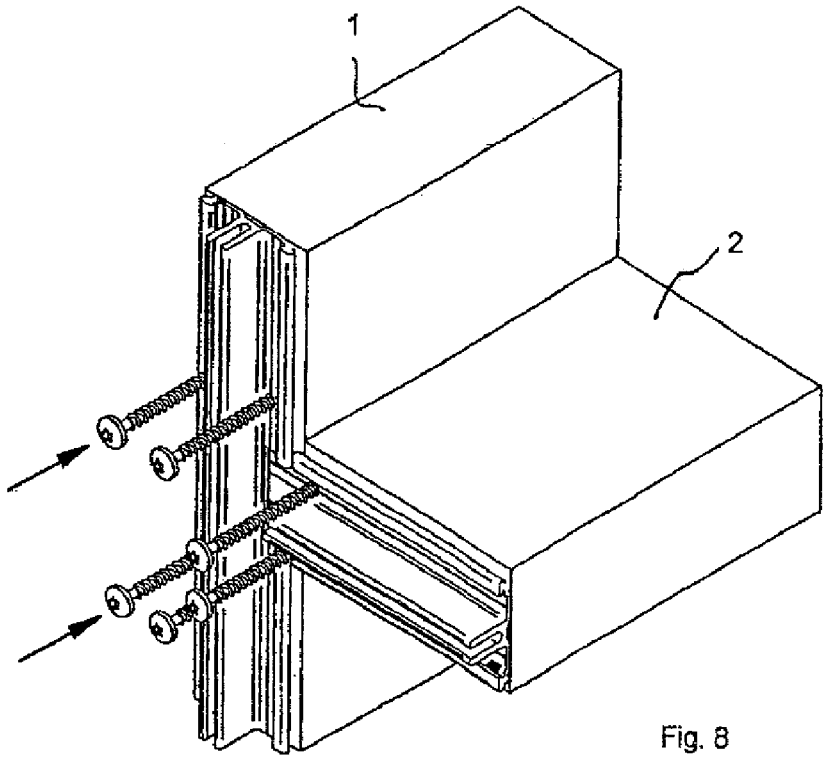
Fig. 8 PRIOR ART
FIG. 8 is a perspective view of a second mounting state of the second connection according to the prior art.

Compared with the prior art shown in the FIGS. 5 and 6, the invention comprises advantages as follows: according to prior art, the metal profiles are not connected to one another. The reinforcing plate 5 is lower in price than the three-arm reinforcing element 6 which must have a greater thickness than the reinforcing plate 5 supported by the projecting profile element of the transom 2. Furthermore, compared with the prior art shown in the FIGS. 7 and 8, the invention comprises another advantages described below. As already mentioned, the projecting tongue can easily be damaged. The T-shaped metal profile 3 of the mullion is cut out and thus, is mechanically weakened. In most cases, the profile is made of aluminum. Because the strength of even high-allowed aluminum is not as high as that of high-alloyed corrosion-resistant steel, the connection according to the invention can mechanically be loaded remarkably stronger.

The invention claimed is:

1. Connecting device for a mullion/transom connection for connecting a mullion (1) to a transom (2), to the front sides of which a T-shaped metal profile (3) having a projecting portion for installing panes of glass is fastened, wherein the mullion (1) is connected to the transom (2) by means of a main connecting device (4) and reinforcing means are provided to increase the stability of the mullion/transom connection, characterized in that the reinforcing means is a reinforcing plate (5) having the following features:

a base-plate portion (5*a*) defining a first plane and provided with fastening holes for fastening to the front side of the mullion (1) which comprises a recess (1*a*) corresponding to a thickness, length and width of the base-plate portion (5*a*), wherein the recess (1*a*) is open laterally and two tongues (5*b*) provided with fastening holes and extending from the base-plate portion in spaced apart relationship to one another in a second plane which is parallel to and outside of the first plane, wherein the tongues engage over the projecting portion of the T-shaped metal profile (3) of the transom (2).

2. Connecting device according to claim 1, characterized in that the reinforcing plate (5) is made of a high-strength high-grade steel.

* * * * *